US008593245B2

(12) United States Patent
Zeng et al.

(10) Patent No.: US 8,593,245 B2
(45) Date of Patent: Nov. 26, 2013

(54) COIL ASSEMBLY AND MAGNETIC ELEMENT WITH SHIELDING FUNCTION

(75) Inventors: Jian-Hong Zeng, Shanghai (CN); Shou-Yu Hong, Shanghai (CN); Nan Ye, Shanghai (CN); Wei Yang, Shanghai (CN); Jian-Ping Ying, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 107 days.

(21) Appl. No.: 12/787,893

(22) Filed: May 26, 2010

(65) Prior Publication Data

US 2010/0301981 A1 Dec. 2, 2010

(30) Foreign Application Priority Data

May 27, 2009 (TW) ..... 98117763 A

(51) Int. Cl.

| | |
|---|---|
| ***H01F 38/30*** | (2006.01) |
| ***H01F 27/36*** | (2006.01) |
| ***H01F 27/32*** | (2006.01) |
| ***H01F 5/00*** | (2006.01) |
| ***H01F 27/28*** | (2006.01) |

(52) U.S. Cl.

USPC ..... 336/84 M; 336/84 R; 336/84 C; 336/200; 336/232

(58) Field of Classification Search

USPC ..... 336/84 R, 84 C, 84 M, 200, 232

See application file for complete search history.

(56) References Cited

U.S. PATENT DOCUMENTS

| | | | | | |
|---|---|---|---|---|---|
| 2,229,373 | A | * | 1/1941 | Cole | 336/84 R |
| 3,517,361 | A | * | 6/1970 | Reifel et al. | 336/84 R |
| 4,558,406 | A | * | 12/1985 | Geissler et al. | 363/126 |
| 4,586,015 | A | * | 4/1986 | Takahara et al. | 336/84 C |
| 4,977,301 | A | * | 12/1990 | Maehara et al. | 219/715 |
| 6,587,026 | B2 | * | 7/2003 | Yeh et al. | 336/223 |
| 2003/0038700 | A1 | * | 2/2003 | Piechnick | 336/208 |

FOREIGN PATENT DOCUMENTS

| | | | |
|---|---|---|---|
| JP | 60213015 | A | * 10/1985 |
| JP | 02159707 | A | * 6/1990 |
| JP | 06151208 | A | * 5/1994 |

* cited by examiner

*Primary Examiner* — Tsz Chan

(74) *Attorney, Agent, or Firm* — Kirton McConkie; Evan R. Witt

(57) ABSTRACT

A coil assembly includes at least one insulated wire and an electromagnetic interference shielding layer. The insulated wire is wound into a winding coil part. The winding coil part includes a first wire-outlet segment, a second wire-outlet segment and a central through-hole. The electromagnetic interference shielding layer is formed on the winding coil part for shielding the insulated wire. The electromagnetic interference shielding layer has lateral projection profile on the winding coil part. The electromagnetic interference shielding layer has a radial gap such that the electromagnetic interference shielding layer is a non-conducting loop.

14 Claims, 10 Drawing Sheets

COIL ASSEMBLY AND MAGNETIC ELEMENT WITH SHIELDING FUNCTION

FIELD OF THE INVENTION

The present invention relates to a coil assembly and a magnetic element, and more particularly to a coil assembly and a magnetic element with shielding functions.

BACKGROUND OF THE INVENTION

Nowadays, magnetic elements such as transformers and inductors are widely used in many electronic devices to generate induced magnetic fluxes. There are many methods for fabricating a magnetic element that is used in a switching power supply apparatus. According to a first method, a single-layered or three-layered insulated wire is wound around a magnetic core. According to a second method, after a coil pancake is produced by winding an insulated wire, the coil pancake is wound around a bobbin and then combined with a magnetic core. According to a third method, after an insulated wire is wound around a bobbin, the bobbin is combined with a magnetic core. Since the switching power supply apparatus has some switch elements, the magnetic element is readily suffered from an electromagnetic interference (EMI) problem. The EMI problem is detrimental to the neighboring circuits or electronic components. Especially, because of the parasitic capacitor between the primary side and the secondary side of the transformer, the transformer is a main reason of causing the EMI problem in the switching power supply apparatus.

For reducing the parasitic capacitor between the primary side and the secondary side of the transformer, a metallic shielding layer is usually arranged between the primary side and the secondary side and then the metallic shielding layer is connected to ground. FIG. 1A is a schematic view illustrating a transformer with a metallic shielding layer according to the prior art. FIG. 1B is a schematic cross-sectional view of the transformer shown in FIG. 1A and taken along the line AA. Hereinafter, a process for fabricating the transformer will be illustrated with reference to FIGS. 1A and 1B. First of all, a primary winding coil 14 is wound around a bobbin 11. Next, a metallic sheet 13 is sheathed around the primary winding coil 14. For preventing from generation of a short-circuited problem, a gap 131 is formed between both ends of the metallic sheet 13 (see FIG. 1B). Next, a secondary coil 12 is wound around the metallic sheet 13. Afterwards, a magnetic core is combined with the bobbin 11, thereby producing the transformer 1.

Although the transformer 1 is effective for reducing the EMI problem, there are still some drawbacks. For example, since the metallic sheet 13 fails to effectively isolate the primary winding coil 14 from the secondary coil 12, the EMI shielding efficacy of the transformer 1 is insufficient.

Therefore, there is a need of providing a coil assembly and a magnetic element with shielding functions so as to obviate the drawbacks encountered from the prior art.

SUMMARY OF THE INVENTION

It is an object of the present invention to provide a coil assembly with a shielding function. The coil assembly is used in a magnetic element. By using the coil assembly of the present invention, the possibility of causing the EMI problem is minimized, the window utilization of the magnetic core is enhanced, and the overall volume of the magnetic element is reduced.

In accordance with an aspect of the present invention, there is provided a coil assembly with a shielding function. The coil assembly includes at least one insulated wire and an electromagnetic interference shielding layer. The insulated wire is wound into a winding coil part. The winding coil part includes a first wire-outlet segment, a second wire-outlet segment and a central through-hole. The electromagnetic interference shielding layer is formed on the winding coil part for shielding the insulated wire. The electromagnetic interference shielding layer has lateral projection profile on the winding coil part. The electromagnetic interference shielding layer has a radial gap such that the electromagnetic interference shielding layer is a non-conducting loop.

In accordance with another aspect of the present invention, there is provided a magnetic element. The magnetic element includes a coil assembly and a magnetic core assembly. The coil assembly includes at least one insulated wire and an electromagnetic interference shielding layer. The insulated wire is wound into a winding coil part. The winding coil part includes a first wire-outlet segment, a second wire-outlet segment and a central through-hole. The electromagnetic interference shielding layer is formed on the winding coil part for shielding the insulated wire. The electromagnetic interference shielding layer has lateral projection profile on the winding coil part. The electromagnetic interference shielding layer has a radial gap such that the electromagnetic interference shielding layer is a non-conducting loop. The magnetic core assembly is partially embedded into the through-hole.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
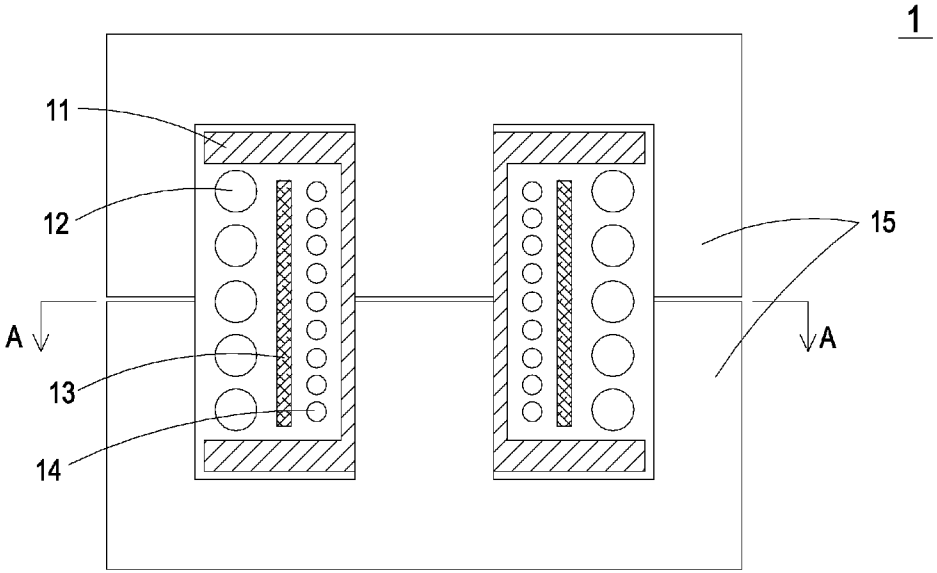
FIG. 1A PRIOR ART
FIG. 1A is a schematic view illustrating a transformer with a metallic shielding layer according to the prior art.
Figure 1B:
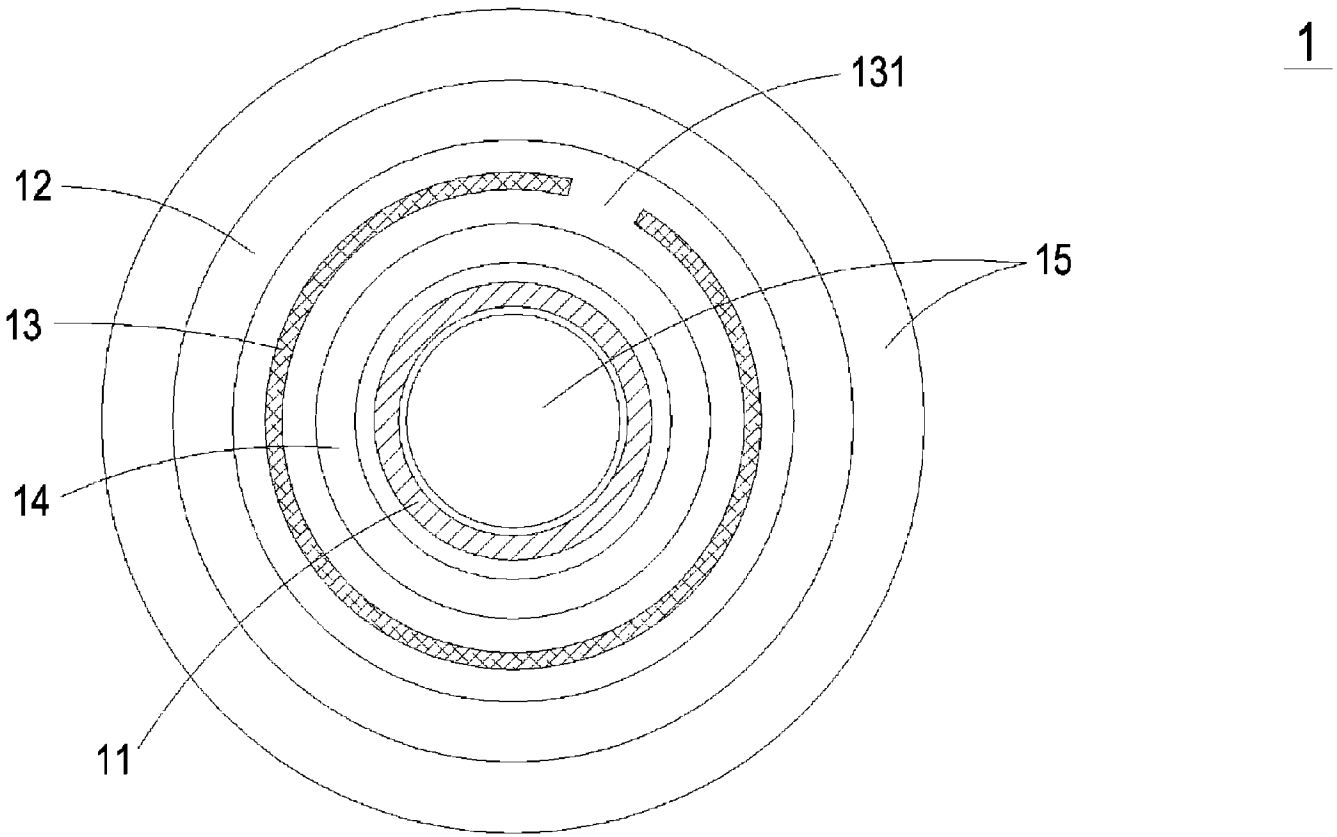
FIG. 1B PRIOR ART
FIG. 1B is a schematic cross-sectional view of the transformer shown in FIG. 1A and taken along the line AA.
Figure 2A:
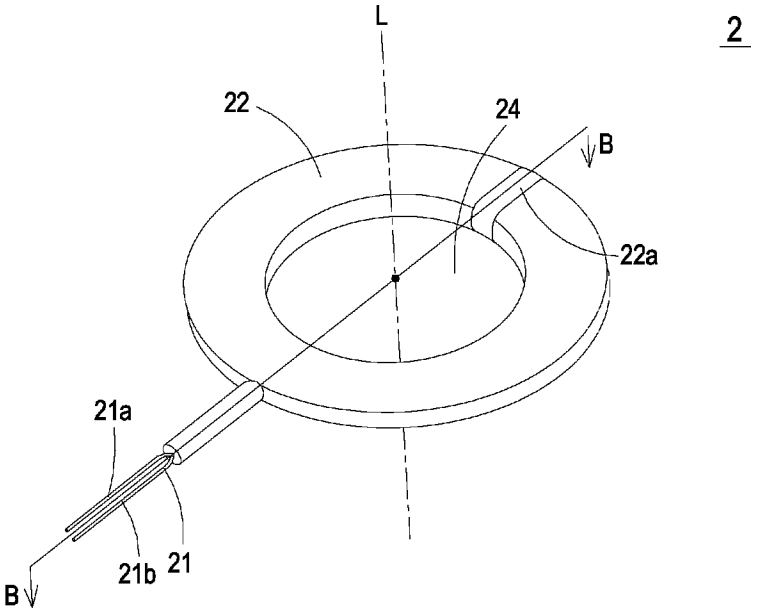
FIG. 2A is a schematic perspective view illustrating a coil assembly with a shielding function according to an embodiment of the present invention.
Figure 2B:
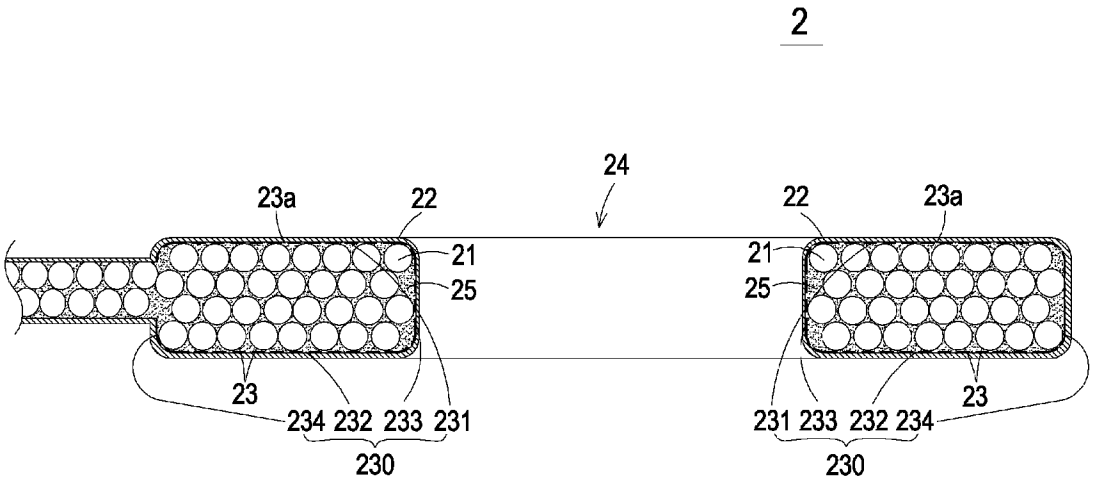
FIG. 2B is a schematic cross-sectional view of the coil assembly shown in FIG. 2A and taken along the line BB.

FIG. 2A is a schematic perspective view illustrating a coil assembly with a shielding function according to an embodiment of the present invention. FIG. 2B is a schematic cross-sectional view of the coil assembly shown in FIG. 2A and taken along the line BB. As shown in FIGS. 2A and 2B, the coil assembly 2 comprises at least one insulated wire 21 and an EMI shielding layer 22. The insulated wire 21 is wound into a winding coil part 23, which includes a ring-shaped body 230, a first wire-outlet segment 21*a* and a second wire-outlet segment 21*b*, wherein the ring-shaped body 230 has an upper surface 231, a lower surface 232, an inner rim 233, and an outer rim 234. The winding coil part 23 includes a through-hole 24 in the center thereof, and the inner rim 233 is opposite to the outer rim 234 and close to the central through-hole 24. The EMI shielding layer 22 is directly formed on the winding coil part 23 for shielding the insulated wire 21, wherein the EMI shielding layer 22 covers at least parts of the inner rim 233 of the ring-shaped body 230 of the winding coil part 23 and has lateral projection profile on the winding coil part 23. In addition, the EMI shielding layer 22 has a radial gap 22*a*, so that the EMI shielding layer 22 is an open loop (or a non-conducting loop). According to the specific configuration, the coil assembly 2 has an EMI shielding function.

Figure 2C:
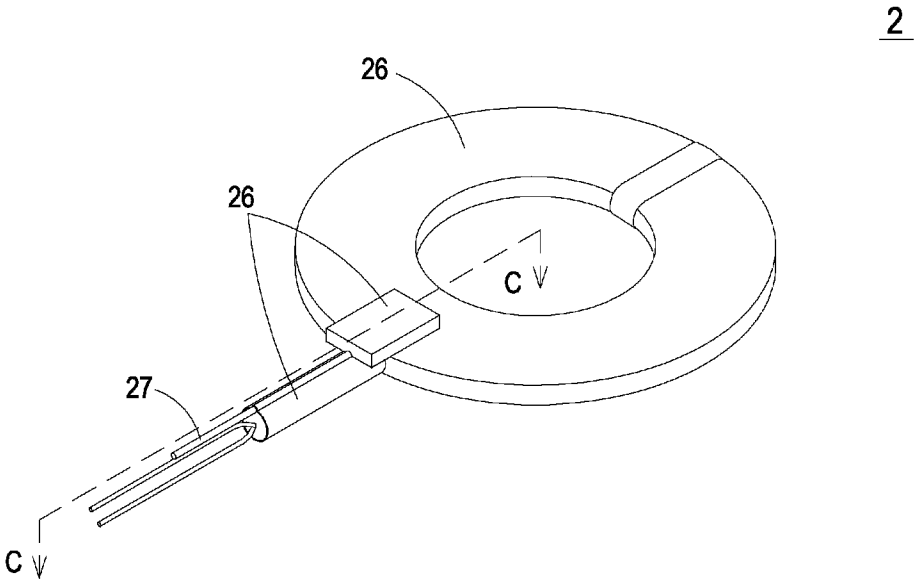
FIG. 2C is a schematic perspective view illustrating a variant of the coil assembly shown in FIG. 2A.
Figure 2D:
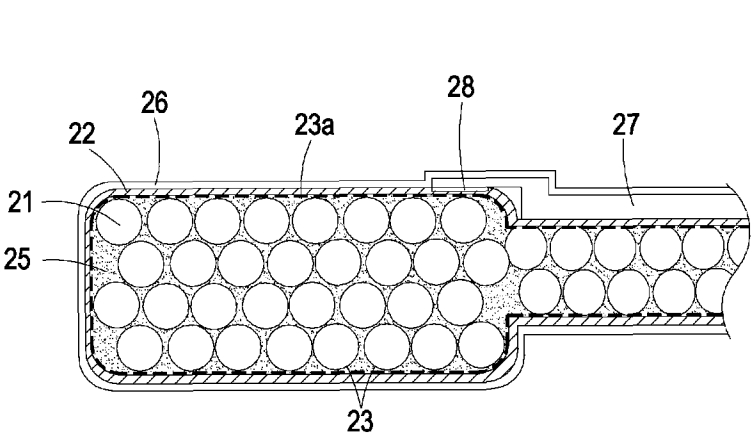
FIG. 2D is a schematic cross-sectional view of the coil assembly shown in FIG. 2C and taken along the line CC.

FIG. 2C is a schematic perspective view illustrating a variant of the coil assembly shown in FIG. 2A. FIG. 2D is a schematic cross-sectional view of the coil assembly shown in FIG. 2C and taken along the line CC. The EMI shielding layer 22 is electrically connected to a ground wire 27 via a conductive adhesive 28. An example of the conductive adhesive 28 includes but is not limited to a solder paste or a conductive adhesive. The coil assembly 2 further includes an insulating layer 26, which is formed on the external surfaces of the EMI shielding layer 22 and the ground wire 27. Preferably, the insulating layer 26 is made of high voltage resistant insulating material in order to increase the EMI shielding efficacy and withstand high voltage. An example of the high voltage resistant insulating material includes but is not limited to parylene.

In some embodiments, the EMI shielding layer 22 is a conductive layer made of conductive material such as metallic material, conductive resin or conductive adhesive. The thickness of the EMI shielding layer 22 is preferably less than 1 micrometer (μm). In some embodiments, the thickness of the EMI shielding layer 22 is in a range of several tens to several hundreds micrometers.

Please refer to FIG. 2A again. The insulated wire 21 is wound into the winding coil part 23 by several turns with respect to the centerline L. In addition, the winding coil part 23 has a single-layered or multi-layer arrangement. As such, the winding coil part 23 is substantially pancake-shaped or ring-shaped.

Please refer to FIGS. 2B and 2D again. The vacancy regions between adjacent turns of the insulated wire 21 of the winding coil part 23 are filled with a bonding agent 25. Via the bonding agent 25, a smooth surface 23*a* is formed on the exterior of the winding coil part 23. As such, the EMI shielding layer 22 could be easily formed on the smooth surface 23*a*. An example of the bonding agent 25 includes but is not limited to an organic bonding agent.

In some embodiments, the first wire-outlet segment 21*a* and the second wire-outlet segment 21*b* could be wound around each other. In some embodiments, the radial gap 22*a* of the EMI shielding layer 22 is formed around the periphery of the insulated wire 21 so that the EMI shielding layer 22 is an open loop (or a non-conducting loop). Moreover, since the EMI shielding layer 22 is directly formed on the winding coil part 23, the bottom of the radial gap 22*a* of the EMI shielding layer 22 is defined by the top surface (or the smooth surface 23*a*) of the winding coil part 23.

Figure 3:
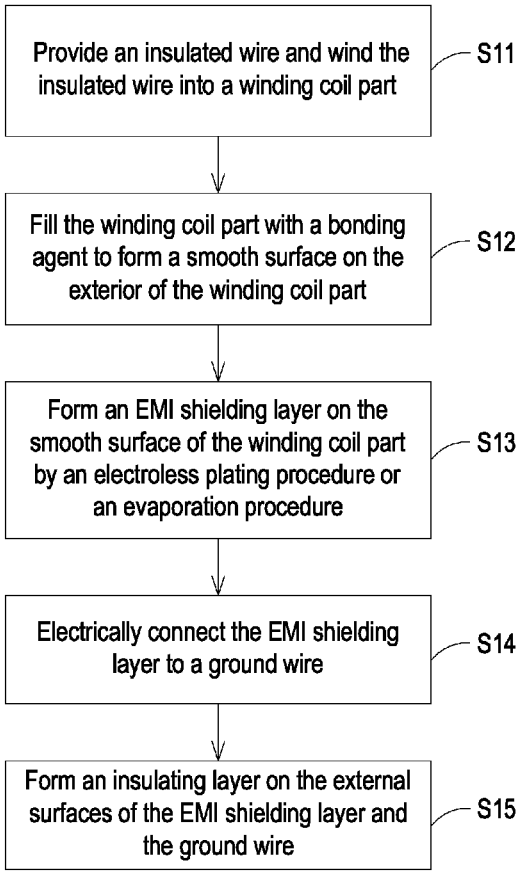
FIG. 3 is flowchart illustrating a process of fabricating the coil assembly according to present invention.

FIG. 3 is flowchart illustrating a process of fabricating the coil assembly according to present invention. First of all, an insulated wire 21 is wound into a winding coil part 23 (Step S11). The winding coil part 23 includes a ring-shaped body 230, a first wire-outlet segment 21*a*, a second wire-outlet segment 21*b*, and a central through-hole 24, wherein the ring-shaped body 230 has an upper surface 231, a lower surface 232, an inner rim 233, and an outer rim 234 and the inner rim 233 is opposite to the outer rim 234 and close to the central through-hole 24. Next, the winding coil part 23 is filled with a bonding agent 25, and a smooth surface 23*a* is formed on the exterior of the winding coil part 23 after the bonding agent 25 is solidified (Step S12). Next, an EMI shielding layer 22 is formed on the smooth surface 23*a* of the winding coil part 23 by an electroless plating procedure, an electroplating procedure, a spray coating procedure, a dip coating procedure or an evaporation procedure, wherein the EMI shielding layer 22 covers at least parts of the inner rim 233 of the ring-shaped body 230 of the winding coil part 23 (Step S13). The EMI shielding layer 22 is a conductor layer. In addition, the EMI shielding layer 22 has a radial gap 22*a*, so that the EMI shielding layer 22 is an open loop (or a non-conducting loop). The thickness of the EMI shielding layer 22 is preferably less than 1 micrometer (μm). For obtaining a thicker or denser conductor layer, the thickness of the conductor layer could be increased to several tens or several hundreds micrometers by a further electroplating procedure after the electroless plating procedure, the electroplating procedure, the spray coating procedure, the dip coating procedure or the evaporation procedure has been performed. In some embodiment, the conductor layer is a metallic mask or other mask. Next, the EMI shielding layer 22 is electrically connected to a ground wire 27 via a conductive adhesive 28 (Step S14). An example of the conductive adhesive 28 includes but is not limited to a solder paste or a conductive adhesive. Afterwards, an insulating layer 26 is formed on the external surfaces of the EMI shielding layer 22 and the ground wire 27 by a chemical vapor deposition (CVD) procedure or other procedure (e.g. a spray coating procedure or a dip coating procedure).

Figure 4:
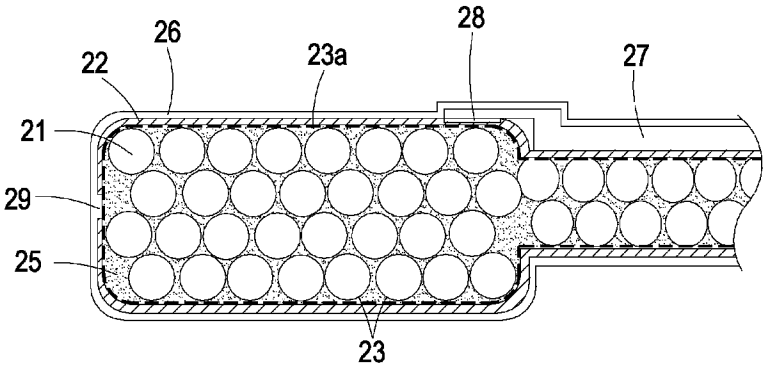
FIG. 4 is a schematic cross-sectional view illustrating a portion of a coil assembly according to another embodiment of the present invention.

FIG. 4 is a schematic cross-sectional view illustrating a portion of a coil assembly according to another embodiment of the present invention. Except that the winding coil part 23 is not completely covered by the EMI shielding layer 22, the configurations of FIG. 4 are substantially identical to those of the coil assembly shown in FIG. 2C. As shown in FIG. 4, the EMI shielding layer 22 has at least an opening 29. The opening 29 is formed in a sidewall of the winding coil part 23. In this embodiment, the insulating layer 26 is formed on the external surfaces of the EMI shielding layer 22, the ground wire 27, the first wire-outlet segment 21*a* and the second wire-outlet segment 21*b* (see also FIG. 2C). In addition, the opening 29 is filled with the insulating layer 26.

Figure 5A:
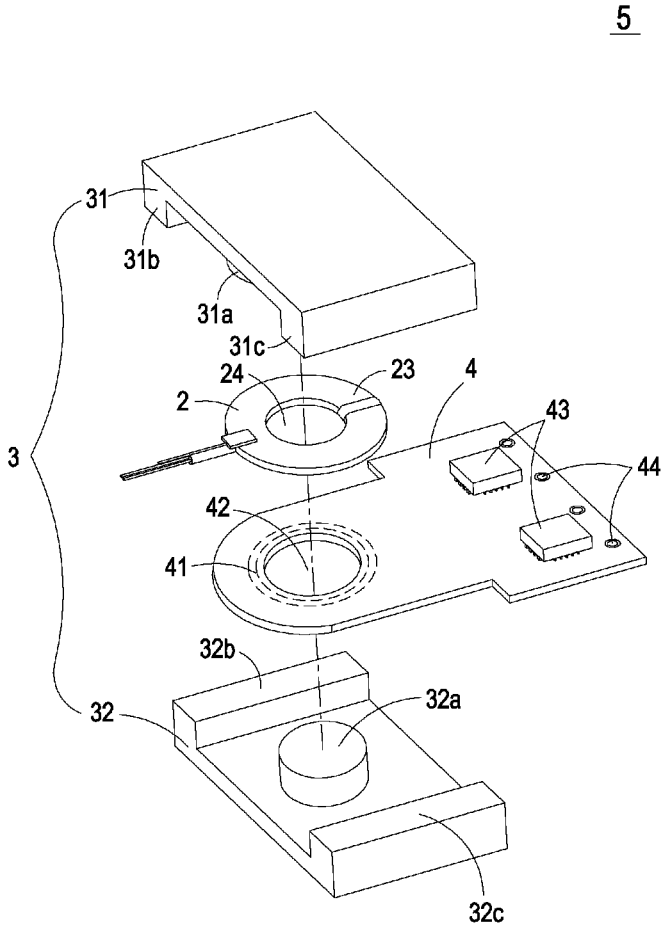
FIG. 5A is a schematic exploded view of a magnetic element using the coil assembly shown in FIGS. 2C and 2D.
Figure 5B:
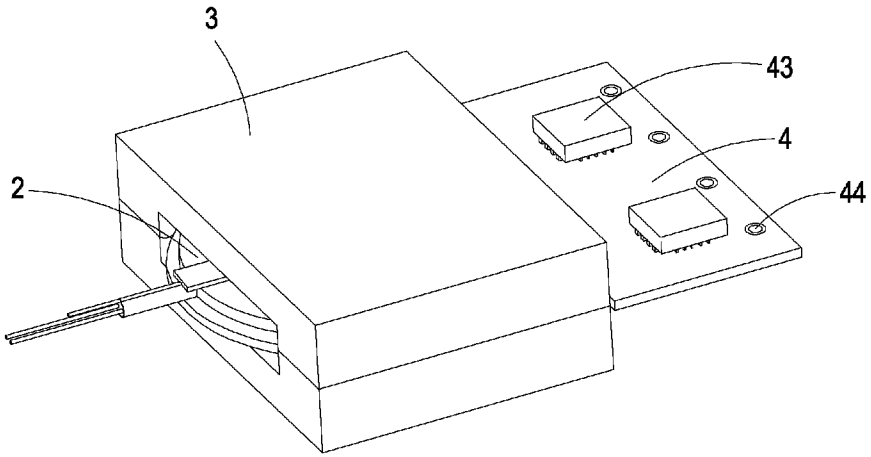
FIG. 5B is a schematic assembled view of the magnetic element shown in FIG. 5A.

FIG. 5A is a schematic exploded view of a magnetic element using the coil assembly shown in FIGS. 2C and 2D. FIG. 5B is a schematic assembled view of the magnetic element shown in FIG. 5A. The magnetic element 5 comprises a coil assembly 2 of the present invention and a magnetic core assembly 3. An example of the magnetic element 5 includes but is not limited to an inductor or a transformer.

The coil assembly 2 comprises at least one insulated wire 21 and an EMI shielding layer 22. The insulated wire 21 is wound into a winding coil part 23, which includes a first wire-outlet segment 21*a*, a second wire-outlet segment 21*b* and a central through-hole 24. The EMI shielding layer 22 is directly formed on the winding coil part 23 for shielding the insulated wire 21, wherein the EMI shielding layer 22 has lateral projection profile on the winding coil part 23. In addition, the EMI shielding layer 22 has a radial gap 22*a*, so that the EMI shielding layer 22 is an open loop (or a non-conducting loop). The EMI shielding layer 22 is electrically connected to a ground wire 27 via a conductive adhesive 28. The coil assembly 2 further includes an insulating layer 26, which is formed on the external surfaces of the EMI shielding layer 22 and the ground wire 27. The insulating layer 26 is made of high voltage resistant insulating material in order to increase the EMI shielding efficacy and withstand high voltage.

The magnetic core assembly 3 is partially embedded into the through-hole 24 of the winding coil part 23. The magnetic core assembly 3 comprises a first magnetic part 31 and a second magnetic part 32. The middle post 31*a* of the first magnetic part 31 and the middle post 32*a* of the second magnetic part 32 are partially embedded into the through-hole 24 of the winding coil part 23 of the coil assembly 2. The lateral posts 31*b*, 31*c* of the first magnetic part 31 and the lateral posts 32*b*, 32*c* of the second magnetic part 32 are contacted with each other to enclose the winding coil part 23 of the coil assembly 2.

In some embodiments, the magnetic element 5 further includes a circuit board 4. The circuit board 4 has a central hollow portion 42. A conductive trace pattern 41 is formed in the internal portion or on an external surface of the circuit board 4. The conductive trace pattern 41 is arranged around the hollow portion 42. The hollow portion 42 of the circuit board 4 is aligned with the through-hole 24 of the coil assembly 2. In addition, the middle post 31*a* of the first magnetic part 31 and the middle post 32*a* of the second magnetic part 32 are partially embedded into the through-hole 24 and the hollow portion 42. The lateral posts 31*b*, 31*c* of the first magnetic part 31 and the lateral posts 32*b*, 32*c* of the second magnetic part 32 are contacted with each other to enclose the winding coil part 23 and the circuit board 4.

In a case that the magnetic element 5 is a transformer, the coil assembly 2 is used as a primary winding coil assembly and the conductive trace pattern 41 of the circuit board 4 is used a secondary winding coil assembly. As a result, the coil assembly 2 and the conductive trace pattern 41 of the circuit board 4 interact with the magnetic core assembly 3 to achieve the purpose of voltage regulation.

The magnetic element 5 of the present invention can be applied to a switching power supply apparatus. Take a transformer for example. The coil assembly 2 is used as a primary winding coil assembly, and the conductive trace pattern 41 of the circuit board 4 is used a secondary winding coil assembly. Since the insulated wire 21 is shielded by the EMI shielding layer 22 and the EMI shielding layer 22 is connected to ground through the ground wire 27, the parasitic capacitor between the primary side and the secondary side of the transformer is reduced and the common-mode noise generated by the magnetic element 5 is reduced. Moreover, the EMI shielding layer 22 is effective for shielding the noise radiation from the primary side.

Please refer to FIG. 5A again. In some embodiments, the circuit board 4 further comprises several switch elements 43 and several conductive holes 44. In some embodiments, the circuit board 4 is could be replaced by a bobbin. Another conductive coil is wound around the bobbin. After the coil assembly, the magnetic core assembly 3 and the bobbin are combined together, another magnetic element is fabricated.

In the above embodiments, the insulated wire 21 is a single-layered or a three-layered insulated wire. The single-layered insulated wire is preferred because the window utilization of the magnetic core is increased when the single-layered insulated wire is used in the magnetic element. In this context, the window utilization of the magnetic core indicates the proportion of copper area relative to the section area of the magnetic core window. That is, as the copper area is increased, the window utilization is increased. Assuming that the magnetic core window is identical, the window utilization of the magnetic core of the transformer using the single-layered insulated wire is larger than that of the transformer using a three-layered insulated wire by approximately 25%. In a case that the transformer is applied to the switching power supply apparatus, the safety regulations for the primary side and the secondary side of the transformer are stringent. For example, the primary side and the secondary side of the transformer should withstand approximately 3000 Vac, which is equivalent to 4242 Vdc. The coil assembly having the single-layered insulated wire is relatively cost-effective. Under this circumstance, the insulating layer 26 is formed on the external surface of the coil assembly 2 in order to meet the safety regulations.

From the above description, the coil assembly and the magnetic element of the present invention have EMI shielding functions by forming the EMI shielding layer on the winding coil part. By using the coil assembly of the present invention, the possibility of causing the EMI problem is minimized, the window utilization of the magnetic core is enhanced, and the overall volume of the magnetic element is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A coil assembly with a shielding function, said coil assembly comprising:

at least one insulated wire wound into a winding coil part, wherein said winding coil part includes a ring-shaped body, a first wire-outlet segment, a second wire-outlet segment and a central through-hole, wherein said ring-shaped body has an upper surface, a lower surface, an inner rim, and an outer rim, and said inner rim is opposite to said outer rim and close to said central through-hole; and an electromagnetic interference shielding layer directly formed on said winding coil part for shielding said insulated wire, wherein said electromagnetic interference shielding layer has lateral projection profile on said winding coil part, and said electromagnetic interference shielding layer has a radial gap such that said electromagnetic interference shielding layer is a non-conducting loop;

wherein said electromagnetic interference shielding layer is a conductor layer;

wherein said electromagnetic interference shielding layer covers at least parts of said inner rim of said ring-shaped body of said winding coil part;

wherein said coil assembly further includes an insulating layer, which is formed on external surfaces of said electromagnetic interference shielding layer, a ground wire, said first wire-outlet segment and said second wire-outlet segment, wherein said ground wire is between said insulating layer and said electromagnetic interference shielding layer.

2. The coil assembly with a shielding function according to claim 1 wherein said electromagnetic interference shielding layer is an inductor layer.

3. The coil assembly with a shielding function according to claim 1 wherein said electromagnetic interference shielding layer is formed on said winding coil part by an electroless plating procedure, an electroplating procedure, a spray coating procedure, a dip coating procedure or an evaporation procedure.

4. The coil assembly with a shielding function according to claim 1 wherein the vacancy regions between adjacent turns of said insulated wire of said winding coil part are filled with a bonding agent, and a smooth surface is formed on an exterior of said winding coil part via said bonding agent.

5. The coil assembly with a shielding function according to claim 1 wherein said insulating layer is formed on said electromagnetic interference shielding layer by a chemical vapor deposition procedure, a spray coating procedure or a dip coating procedure.

6. The coil assembly with a shielding function according to claim 1 wherein said electromagnetic interference shielding layer further includes at least an opening.

7. The coil assembly with a shielding function according to claim 1 wherein said ground wire is electrically connected to said electromagnetic interference shielding layer.

8. The coil assembly with a shielding function according to claim 7 wherein said electromagnetic interference shielding layer is electrically connected to said ground wire via a conductive adhesive.

9. The coil assembly with a shielding function according to claim 1 wherein said radial gap of said electromagnetic interference shielding layer is formed around the periphery of said insulated wire.

10. A magnetic element comprising:

a coil assembly comprising:

at least one insulated wire wound into a winding coil part, wherein said winding coil part includes a ring-shaped body, a first wire-outlet segment, a second wire-outlet segment and a central through-hole, wherein said ring-shaped body has an upper surface, a lower surface, an inner rim, and an outer rim, and said inner rim is opposite to said outer rim and close to said central through-hole; and an electromagnetic interference shielding layer directly formed on said winding coil part for shielding said insulated wire, wherein said electromagnetic interference shielding layer has lateral projection profile on said winding coil part, and said electromagnetic interference shielding layer has a radial gap such that said electromagnetic interference shielding layer is a non-conducting loop;

wherein said electromagnetic interference shielding layer is a conductor layer;

wherein said electromagnetic interference shielding layer covers at least parts said inner rim of said ring-shaped body of said winding coil part; and wherein said coil assembly further includes an insulating layer, which is formed on external surfaces of said electromagnetic interference shielding layer, and a ground wire, which is disposed between said insulating layer and said electromagnetic interference shielding layer; and a magnetic core assembly partially embedded into said through-hole.

11. The magnetic element according to claim 10 wherein said magnetic element is a transformer or an inductor.

12. The magnetic element according to claim 10 further comprising a circuit board, wherein said circuit board includes a hollow portion and a conductive trace pattern around said hollow portion, said hollow portion of said circuit board is aligned with said through-hole of said coil assembly, and said magnetic core assembly is partially embedded into said through-hole and said hollow portion.

13. The magnetic element according to claim 10 wherein said radial gap of said electromagnetic interference shielding layer is formed around the periphery of said insulated wire.

14. A process of fabricating a coil assembly with a shielding function, comprising steps of:

providing an insulated wire and winding said insulated wire into a winding coil part, wherein said winding coil part includes a ring-shaped body, a first wire-outlet segment, a second wire-outlet segment and a central through-hole, said ring-shaped body has an upper surface, a lower surface, an inner rim, and an outer rim, and said inner rim is opposite to said outer rim and close to said central through-hole;

filling said winding coil part with a bonding agent to form a smooth surface on the exterior of said winding coil part;

forming an electromagnetic interference shielding layer on said smooth surface of said winding coil part by an electroless plating procedure or an evaporation procedure, wherein said electromagnetic interference shielding layer is a conductor layer, and wherein said electromagnetic interference shielding layer covers at least parts of said inner rim of said ring-shaped body of said winding coil part;

electrically connecting said electromagnetic interference shielding layer to a ground wire; and forming an insulating layer on the external surfaces of said electromagnetic interference shielding layer and said ground wire, wherein said ground wire is between said insulating layer and said electromagnetic interference shielding layer.

* * * * *